US005428937A

United States Patent [19]

Misik

[11] Patent Number: 5,428,937

[45] Date of Patent: Jul. 4, 1995

[54] MACHINE FOR PACKAGING NEWSPAPERS

[75] Inventor: Albert V. Misik, Los Angeles, Calif.

[73] Assignee: Belco Packaging Systems, Inc., Pasadena, Calif.

[21] Appl. No.: 127,818

[22] Filed: Sep. 28, 1993

[51] Int. Cl.[6] ..... B65B 9/02

[52] U.S. Cl. ..... 53/74; 53/389.3; 53/553

[58] Field of Search ..... 53/74, 66, 553, 548, 53/221, 229, 228, 389.3, 389.2

[56] References Cited

U.S. PATENT DOCUMENTS

| | | | |
|---|---|---|---|
| 3,559,367 | 2/1971 | Misik | 53/74 |
| 3,792,561 | 2/1974 | Carnes | 53/553 X |
| 3,866,389 | 2/1975 | Elsner et al. | 53/553 X |
| 4,313,288 | 2/1982 | Tassi et al. | 53/74 |
| 4,319,443 | 3/1982 | Watts, Jr. | 53/466 |
| 4,991,376 | 2/1991 | Backman | 53/553 X |

*Primary Examiner*—James F. Coan
*Attorney, Agent, or Firm*—Christie, Parker & Hale

[57] ABSTRACT

A machine for packaging newspapers comprises a conveyor which transports a newspaper through an entrance into the machine. The newspaper imparts a tension on both a top sheet, deployed from a first roll, and a bottom sheet, deployed from a second roll. A top and bottom dance bar communicates with the top and bottom sheet, respectively. In response to the tension, each dance bar simultaneously releases a brake and activates an electric motor, causing the first and second rolls to rotate and feed out the top and bottom sheet, respectively. The top and bottom sheet is guided over the top and bottom surface of the newspaper by a pair of first and second edge guides, respectively, for preventing lateral movement of the top and bottom sheets. A cutting and sealing mechanism comprising a front sealing bar is placed into contact with the top and bottom sheets near the rear edge of the newspaper for simultaneously sealing together and cutting the top and bottom sheets. The front sealing bar comprises a heated metal body having a cutting blade protruding from a sealing edge.

21 Claims, 3 Drawing Sheets

MACHINE FOR PACKAGING NEWSPAPERS

FIELD OF THE INVENTION

This invention relates to newspaper packaging and, more particularly, to a machine for efficiently packaging newspapers in a protective film.

BACKGROUND

The major portion of the circulation of most newspapers is delivered to the home of the readers. The labor involved in home delivery makes this operation expensive. Newspapers are commonly printed and delivered to the local distributor a section at a time as the sections are completed. In this way, an efficient use is made of labor and equipment. Further, many features requiring long preparation can be reported as well as the most current news, which is contained in the last section to arrive at the distributor. A great deal of time is expended by the distributor by in assembling the sections of the newspaper prior to home delivery. To prevent the sections from coming apart, they are folded inside one another. In the case of many Sunday newspaper, for example, the process of assembling the sections of the newspaper begins about a week in advance and proceeds gradually until the time of delivery.

For many years, it has been the practice of delivery boys to roll or fold each newspaper into a bundle in order to throw it more easily without having it come apart. Recently, newspaper distributors started packaging newspapers in a protective film during bad weather to prevent them from becoming wet. Following the common practice, each newspaper is rolled or folded into a bundle and then packaged. When the newspaper is a thick one, the packaged bundle is difficult to grasp because of its large diameter and slick outer surface. When the packaging operation is performed by hand, it further adds to the time required to prepare the newspaper for delivery. There are machines in existence for rolling the newspapers in a bundle and packaging them in a protective film. These machines are, however, complex and difficult to operate. There are also machines in existence for packaging elongated articles other than newspapers. However, these machines do not meet the special problems presented by newspaper packaging.

Machines for packaging newspaper are known in the art. One such machine is disclosed in U.S. Pat. No. 3,559,367 which is hereby incorporated by reference. The machine disclosed in this patent allows for a newspaper to be packaged as each newspaper is carried individually in a flat horizontal position through the machine. As each newspaper is carried into the machine its leading edge contacts a continuous sheet of protective material. The protective material is drawn from a top roll positioned above the paper and the bottom roll positioned beneath the paper. As each newspaper travels through the machine the force of the protective sheet against the leading edge of the newspaper causes the protective sheets to be drawn from the top and bottom rolls. After the newspaper is completely enveloped on its top surface and bottom surface by the protective sheets a sealing and cutting mechanism is activated that operates to seal the top and bottom protective sheets together and simultaneously cuts a sealed portion of the protective sheets.

Although the device disclosed in U.S. Pat. No. 3,559,367 addresses the need of packaging a newspaper in a protective film, it does not disclose the optimal solution. For example, although most weekend newspapers are fairly thick, most weekday papers are relatively thin which has been found to cause problems in machines where the protective material is dispensed onto the surface of the newspaper by the newspapers leading edge against the protective sheet. As the weekday paper is passed through the machine its leading edge comes into contact with the protective sheet. However, as the paper is carried through the machine the force exerted on the leading edge of the newspaper by the protective sheet overcomes the newspaper rigidly, causing the newspaper to bend and fold as it passes through the machine. Ultimately, this may result in newspapers of lessor contents.

For example, U.S. Pat. No. 3,559,367 discloses a machine for packaging newspapers that envelopes a newspaper in a sheet of protective material as it is individually carried in a flat, horizontal position by conveyor through the machine. This reference is hereby incorporated by reference. As the newspaper enters the machine its leading edge comes into contact against a sheet of protective material that is drawn from a top roll residing, above the newspaper, and a bottom roll, that resides below the newspaper. As the newspaper is continuously carried through the machine a section of the protective sheet drawn from the top roll is forced over the top surface of the newspaper. At the same time, a section of the protective sheet drawn from the bottom roll is forced over the bottom surface of the newspaper.

The protective sheets are drawn from the top and bottom rolls by the force of the leading edge of the newspaper against the protective sheet. After the newspaper has traveled a sufficient distance through the machine such that its top and bottom surfaces are completely covered, a sealing and cutting mechanism is activated that seals the protective sheets from the top and bottom roll together, and simultaneously cuts a sealed portion of the protective sheet at the end of the newspaper.

Although in U.S. Pat. No. 3,559,367 discloses a machine for packaging newspapers, it does not solve all of the special problems inherent in newspaper packaging. For example, the thickness and, thus a newspaper's rigidity, may vary depending on whether the newspaper is a weekday or week end edition. Newspapers that report the weekly news tend on average to have a smaller contents and be thinner than weekend newspapers. Accordingly, a newspaper wrapping machine should be constructed that would accommodate the size fluctuations between weekday and weekend papers.

The machine described in U.S. Pat. No. 3,559,367 is known to experience problems when it is used to wrap newspapers having a small contents such as a weekday newspaper. As the newspaper enters the machine its leading edge is brought into contact with the sheet of protective material. As the newspaper is carried through the machine, due to the decreased rigidity of the newspaper, the force needed to draw the protective sheets from the top and bottom rolls overcomes the rigidity of the newspaper, causing the paper to bend and fold up within the wrapping. This bending and folding of weekday newspapers during the wrapping operation produces a product that must be rewrapped before delivery to the customer that will defeat the efficiency of using a machine. Ultimately, using the machine to process such papers may slowdown, jam, or even cause the machine to shut down. Accordingly, a need exists for a machine that can package newspapers in an effective manner regardless of the particular thickness of the newspaper.

BRIEF SUMMARY OF THE INVENTION

There is, therefore, provided in practice of this invention according to a presently preferred embodiment, an improved machine for packaging newspapers. The machine comprises a conveyor for transporting a newspaper through the machine. A first edge guide is located at each end of the entrance to the machine above the plane of the conveyer. Each first edge guide comprises a pair of vertically arranged wheels that are placed in contact with one another by spring force. The side edges of a top sheet of protective material deployed from a first roll are placed between the wheels of each first edge guide to prevent the lateral movement of the top sheet as it is drawn over the top surface of a newspaper.

A second edge guide is located at each end of the entrance to the machine coplaner with the plane of the conveyer. Each second edge guide, like each first edge guide, comprises a pair of vertically arranged wheels that are placed in contact with one another by spring force. The side edges of a bottom sheet of protective material deployed from a second roll are placed between the wheels of each second edge guide to prevent the lateral movement of the bottom sheet as it is drawn over the bottom surface of a newspaper.

A top dance bar is rotatably mounted to a top pivot arm supported above the plane of the conveyer. The top sheet is routed across the surface of the top dance bar so that the top dance bar will pivot upwards in response to tension imposed upon the top sheet. A top electric switch connects with the top pivot arm. A top brake comprises a strap of material connected to the top pivot arm that imposes a frictional force upon the first roll. Upward movement by the top dance bar will cause simultaneous activation of the top electric switch and release of the top brake. A bottom dance bar is rotatably mounted to a bottom pivot arm supported below the plane of the conveyer. The bottom sheet is routed across the surface of the bottom dance bar so that the bottom dance bar will pivot upwards in response to tension imposed upon the bottom sheet. A bottom electric switch is connected to the bottom pivot arm. A bottom brake comprises a strap of material connected to the bottom pivot arm that imposes a frictional force upon the second roll. Upward movement by the bottom dance bar will cause simultaneous activation of the bottom electric switch release of the bottom brake.

A first electric motor is connected to the first roll to rotate the first roll and deploy the top sheet of protective material. A second electric motor is connected to the second roll to rotate the second roll and deploy the bottom sheet of protective material. The first and second electric motors are operated by the top and bottom electric switches, respectively.

After the newspaper is completely enveloped by the protective sheets a sealing and cutting mechanism is activated. A front sealing bar is lowered onto the protective sheets near the rear edge of the newspaper. The front sealing bar comprises a metal body having a sufficient length to accommodate the width of the protective sheet. A heating element is disposed within the metal body to transfer heat to a rounded sealing edge. The sealing edge may be coated with a non-stick material to order to prevent the accumulation of melted protective film. A cutting blade protrudes a predetermined amount from the surface of the sealing edge. The front sealing bar simultaneously seals together and cuts the top and bottom sheets.

Once the protective sheets are simultaneously cut and sealed, the dance bars return to their resting position, the electric switches are deactivated and the brakes are applied, stopping the operation of the electric motors and the rotation of the first and second rolls.

BRIEF DESCRIPTION OF THE DRAWINGS

The features of a specific embodiment of the invention are illustrated in the drawings, in which.

DETAILED DESCRIPTION

Figure 1:
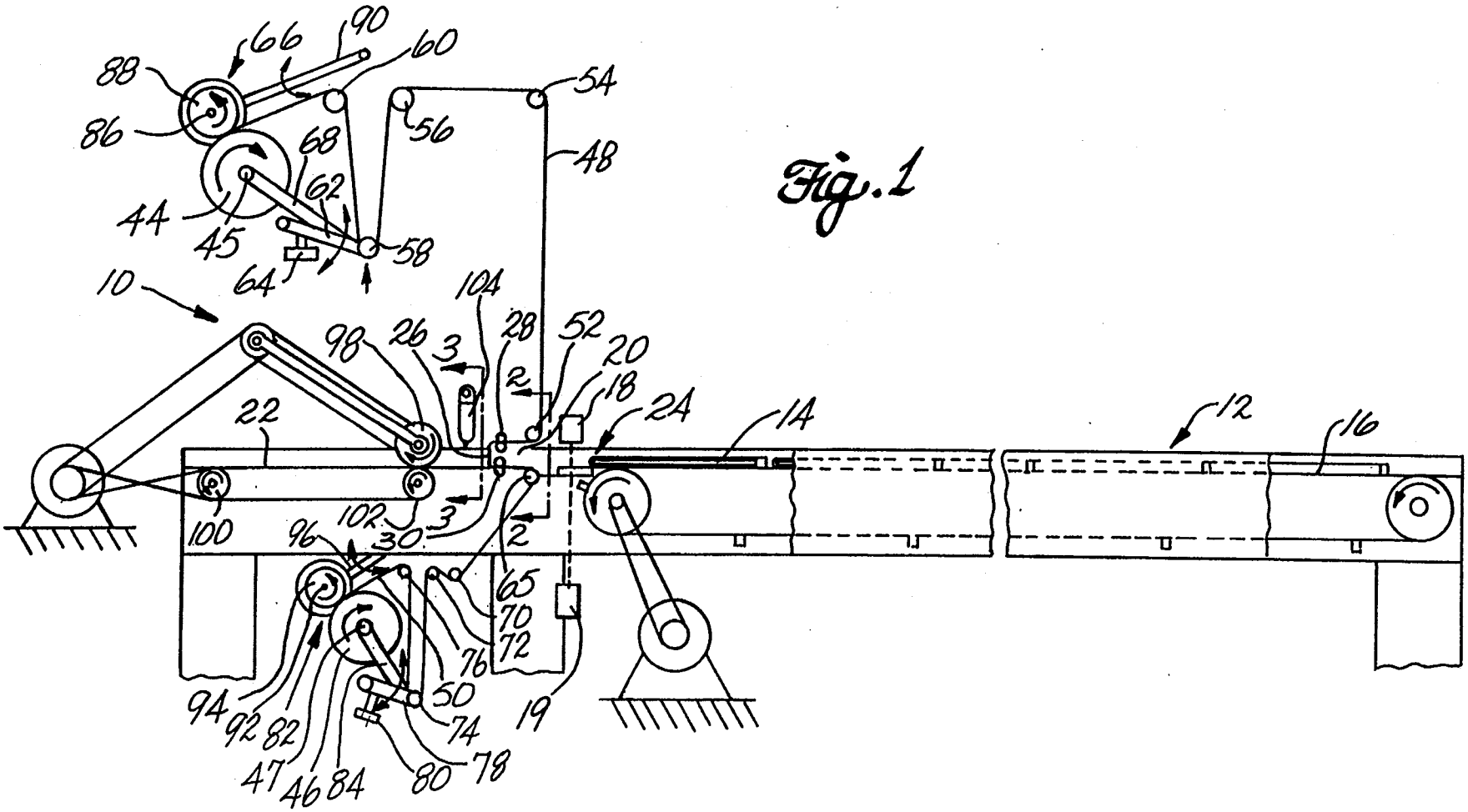
FIG. 1 is a side elevational view of a machine incorporating the features of the invention.

This invention is an improvement on the machine for wrapping newspapers disclosed in U.S. Pat. No. 3,559,367, which is hereby incorporated by reference. The principles of this invention relate to improving the manner in which the sheets of protective material are deployed over the top and bottom surfaces of a newspaper as it is carried through the newspaper wrapping machine 10, as shown in FIG. 1. These improvements will permit the machine to be used to wrap any newspaper, regardless of its thickness. The principles of this invention also relate to improving: (1) the manner in which sheets of protective material are placed over the top and bottom surfaces of a newspaper to avoid unwanted lateral movement; and (2) the manner in which a sealed portion of the protective material is cut after the newspaper has been completely enveloped so as to avoid an unwanted build up of the protective material at the cutting mechanism.

FIG. 1 illustrates a preferred embodiment of the newspaper wrapping machine 10, or newspaper wrapping station, according to principles of this invention. The newspaper wrapping machine 10 may reside at one end of a transport and assembly station 12 that is used for assembling the various sections which make up the newspaper 14. As each newspaper is assembled it is transported via a transport conveyer 16 in a flat, horizontal position to the newspaper wrapping machine. The transport conveyer 16 can either be activated by electric motor or it can be manually activated. Alternatively, the newspaper wrapping machine can be used independently of a transport and assembly station by manually feeding each newspaper into the entrance of the newspaper wrapping machine.

The newspaper wrapping machine 10 comprises a light source 18 near its entrance 20 that registers when a newspaper has entered the machine 10 from the transport and assembly station 12. The light source is directed to shine a beam of light to a photocell 19. Once a newspaper has entered the machine and breaks the beam of the light source to the photocell, an electric circuit is completed that energizes a motor which operates a conveyer 22 within the newspaper wrapping machine 10. The newspaper is carried past the light source and a predetermined distance into the entrance of the newspaper wrapping machine by the transport conveyer 16 before being picked up by the conveyer 22 within the newspaper wrapping machine.

As the newspaper is carried into the entrance of the newspaper wrapping machine its leading edge 24 comes into contact with a continuous sheet of protective material 26. The sheet of protective material is guided over the top and bottom surfaces of the newspaper as it is carried through the newspaper wrapping machine by a pair of horizontally opposed first edge guides 28, and a pair of horizontally opposed second edge guides 30, respectively. Each first and second edge guide is located at opposing ends of the entrance 20 to the machine.

Figure 2:
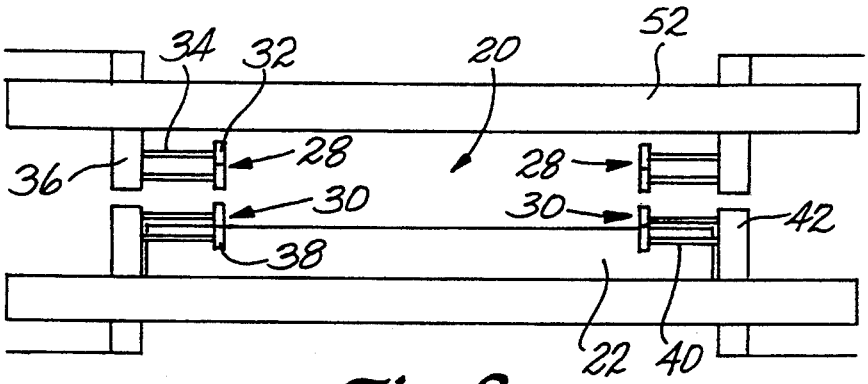
FIG. 2 is a front view of an entrance to the machine illustrating a pair of first edge guides and a pair of second edge guides.

As shown in FIG. 2, each first edge guide 28 comprises two guide wheels 32 that are each rotatably mounted at their axis to an end of a first guide axle 34. Each first guide axle extends horizontally from a first guide mount 36 which is supported above the plane of the conveyer and extends vertically near each end of the entrance to the machine. Each first guide mount accommodates two first guide axles 34 making up the first edge guides 28 at one end of the entrance 20 to the machine. The first guide axles are mounted vertically adjacent to one another in the first guide mount so that the first guide wheels have a parallel axis of rotation and the outside circumference of the first guide wheels contact one another. The first guide axles are connected to the first guide mount such that a spring force is applied to each guide axle in order to maintain a predetermined amount of spring force between the adjacent first guide wheels. The predetermined degree of spring force applied to each guide axle may be that amount that will permit the sheet of protective material to pass between the first guide wheels without causing the protective sheet to tear or otherwise deform.

Each first edge guide 28 comprises a first guide mount 36, a pair of first guide axles 34 attached to the first guide mount, and a pair of first guide wheels 32 attached to the ends of each first guide axle. Each first edge guide is positioned at opposing ends of the entrance to the machine with the first guide wheels 32 directed inwardly towards the center of the entrance and towards each other such that the axis of rotation for a wheel in one first edge guide is parallel and aligned with the axis of rotation for a respective wheel of the opposing first edge guide. Each first edge guide is positioned above the plane of the conveyer 22 such that the point of contact between the first guide wheels 32 of each first edge guide is coplaner with the top surface of a newspaper being carried through the newspaper wrapping machine.

Like the pair of first edge guides, each second edge guide 30 also comprises a set of second guide wheels 38. As shown in FIG. 2, each second guide wheel is rotatably attached at its axis to an end of a second guide axle 40 which is horizontally mounted to second guide mount 42. The second guide mount is supported below the plane of the conveyor and extends vertically near each end of the entrance to the machine. Each second guide mount accommodates two second guide axles 40 making up each second edge guide 30 located at one end of the entrance 20 to the machine. The second guide axles are mounted vertically adjacent to one another in the second guide mount so that the second guide wheels have a parallel axis of rotation and the outside circumference of the second guide wheels contact one another. The second guide axles are connected to the second guide mount such that a spring force is applied to each guide axle in order to maintain a predetermined amount of spring force between the adjacent second guide wheels. The predetermined degree of spring force applied to each guide axle may be that amount that will permit the sheet of protective material to pass between the second guide wheels without causing the protective sheet to tear or otherwise deform.

Each second edge guide 30 comprises a second guide mount 42, a pair of second guide axles 40 attached to the second guide mount, and a pair of second guide wheels 38 attached to the ends of each second guide axle. Each second edge guide is positioned at opposing ends of the entrance to the machine with the second guide wheels 38 directed inwardly towards the center of the entrance and towards each other such that the axis of rotation for a wheel in one second edge guide is parallel and aligned with the axis of rotation for a respective wheel of the opposing second edge guide. Each first edge guide is positioned coplaner with the plane of the conveyer 22 such that the point of contact between the second guide wheels 38 of each second edge guide is coplaner with the bottom surface of a newspaper being carried through the newspaper wrapping machine.

As the newspaper is carried through the newspaper wrapping machine the pair of first edge guides 28 serve to guide a sheet of protective material from a first roll 44, rotatably supported in a horizontal position above the plane of the conveyer 22, over the top surface of the newspaper. The sheet of protective material from the first roll is routed over a series of rotatable cylinders and into the entrance of the newspaper wrapping machine where each side edge of the sheet is interposed between the spring-loaded guide wheels 32 of the first edge guides 28. The spring force between the first guide wheels serves to impose a sufficient degree of force upon the sheet, as it is passed between the guide wheels, to prevent the sheet from moving laterally as it is deposited over the top surface of the newspaper.

Similarly, as the newspaper is carried through the newspaper wrapping machine the second edge guides 30 serve to guide a sheet of protective material from a second roll 46, rotatably supported in a horizontal position below the plane of the conveyer 20, over the bottom surface of the newspaper. The sheet of protective material from the second roll is routed over a rotatable cylinder and into the entrance of the newspaper wrapping machine where each side edge of the sheet is interposed between the spring-loaded guide wheels 38 of the second edge guides 30. The spring force between the second guide wheels serves to impose a sufficient degree of force upon the sheet, as it is passed between the guide wheels, to prevent the sheet from moving laterally as it is deposited over the bottom surface of the newspaper. Lateral movement of the sheets of protective material from either the first or second roll is not desirable during the newspaper wrapping operation because such movement may adversely affect the ability of the machine to envelope and seal the entire surface of the newspaper.

The newspaper wrapping machine envelopes each newspaper by covering both the top and bottom surfaces of the newspaper with a sheet of protective material drawn from a first and second roll, respectively. For purposes of reference the sheet of protective material deployed from the first roll 44 will hereafter be referred to as the top sheet 48. Conversely, the sheet of protective material deployed from the second roll 46 will hereafter be referred to as the bottom sheet 50. Additionally, for purposes of reference, components of the newspaper wrapping machine supported above the plane of the conveyer will be referred to as top components, and components supported below the plane of the conveyer will be referred to as bottom components.

The width of the top and bottom sheets are sized slightly larger than necessary to accommodate the top and bottom surface of a newspaper so that a portion of each sheet extends uniformly beyond the side edges of the respective surface of the newspaper. Once the top and bottom surfaces of the newspaper have been completely covered, a sealing mechanism is activated to seal together the portions of the top and bottom sheets that extend beyond the side edges of the newspaper and, thus envelope the newspaper. Any lateral movement of the top or bottom sheet during the covering operation could adversely affect its placement on the respective newspaper surface and, thus prevent the formation of a uniformly extended portion. The resulting misalignment between the extended portions of the top and bottom sheet could ultimately impair the ability to obtain a proper seal between the sheets on opposing sides of the newspaper. In order to accommodate such lateral movement during the newspaper wrapping operation the practice has been to use top and bottom sheets having a width much wider in dimension than that of the newspaper.

The pair of first and second edge guides act to prevent the lateral movement of the respective top and bottom sheets by routing the side edge of each sheet between a pair of spring-loaded guide wheels. These guide wheels permit the movement of the sheet over the wheels in the direction of rotation but possess a sufficient degree of spring force between each wheel to prevent the movement of the sheet in a direction perpendicular to the direction of rotation, i.e., lateral movement. Eliminating such lateral movement by the sheet improves the ability of the machine to envelope and completely seal a newspaper with the protective material. Further, eliminating the lateral movement permits the use of top and bottom sheets having a smaller width than previously needed, resulting in a material savings.

As a newspaper enters the wrapping machine its leading edge 24 contacts the sheet of protective material 26 which causes the sheets of protective film from the first and second rolls to be drawn through the first and second edge guides and over the top and bottom surface of the newspaper, respectively. As the leading edge of the newspaper continues to exert force on the protective sheet a tension is imparted onto the sheet of protective material from the first and second rolls, i.e., the top and bottom sheets, respectively.

As the top sheet 48 is drawn over the top surface of the newspaper it is passed through the pair of first edge guides 28 and is routed and passed over a top feed roller 52, rotatably supported near the entrance of the wrapping machine, a first top roller 54 and second top roller 56, each rotatably supported in a horizontal position above the plane of the first roll, a top dance bar 58, hingedly supported in a horizontal position below the plane of the first roll, and a third top roller 60 rotatably supported in a horizontal position above the plane of the first roll. As shown in FIG. 1, the top sheet may be routed from the first roll 44 in an upward direction over the third top roller 60, downward from the third top roller over the top dance bar 58, upward from the top dance bar over the second top roller 56, horizontally from the second top roller over the first top roller 54, vertically from the first top roller to the top feed roller 52, and horizontally from the top feed roller into the entrance 20 and through the pair of first edge guides 28.

The top feed, first, second and third top rollers may each comprise a cylindrical bar which is rotatably mounted and is of sufficient length to accommodate the passage of the top sheet across its surface. The top dance bar 58 may comprise a cylindrical bar which is rotatably mounted to one end of a top pivot arm 62. The other end of the top pivot arm 62 is hingedly mounted below the plane of the first roll 44. The top dance bar serves to maintain a predetermined amount of tension on the top sheet during the newspaper wrapping operation.

A top electric switch 64 may be mounted below the plane of the first roll at a position that contacts the top pivot arm 62 when the top pivot arm is in its most downward position, or at rest. The top electric switch 64 is configured to activate a first electric motor 66 that causes the rotation of the first roll 44. A top brake 68, may be mounted to the top pivot arm to brake the rotation of first roll. The top brake may comprise a strap of material attached at one end to the top pivot arm that extends to, and is wrapped around, the circumference of a first roll axle 45. The strap may be of sufficient length so, when in the top pivot is in its resting position, the top pivot exerts a tension on the strap, imposing a frictional force upon the first roll axle to stop its rotation.

As the bottom sheet 50 is drawn over the bottom surface of the newspaper it is passed through the pair of second edge guides 30 and is routed and passed over a bottom feed roller 65, rotatably supported near the entrance of the wrapping machine at a position coplaner with the plane of the conveyor 22, a first bottom roller 70 and second bottom roller 72, each rotatably supported in a horizontal position above the plane of the second roll, a bottom dance bar 74, hingedly supported in a horizontal position below the plane of the conveyor, and a third bottom roller 76 rotatably supported in a horizontal position above the plane of the second roll. As shown in FIG. 1, the bottom sheet may be routed from the second roll 46 in an upward direction over the third bottom roller 76, downward from the third top roller over the bottom dance bar 74, upward from the bottom dance bar over the second bottom roller 72, horizontally from the second bottom roller over the first bottom roller 70, upwardly from the first bottom roller to the bottom feed roller 65, and horizontally from the bottom feed roller into the entrance 20 and through the pair of second edge guides 30.

The top feed, first, second and third bottom rollers may each comprise a cylindrical bar which is rotatably mounted and is of sufficient length to accommodate the passage of the bottom sheet across its surface. Like the top dance bar, the bottom dance bar 58 may also comprise a cylindrical bar which is rotatably mounted to one end of a bottom pivot arm 78. The other end of the bottom pivot arm is hingedly mounted below the plane of the second roll 46. The bottom dance bar serves to maintain a predetermined amount of tension on the bottom sheet during the newspaper wrapping operation. The top and bottom dance bar are referred to as a "dance bar" because each bar moves up and down, "or dances", intermittently as newspapers enter the newspaper wrapping machine and exert tension on the top and bottom sheets, respectively.

A bottom electric switch 80 may be mounted below the plane of the second roll at a position that contacts the bottom pivot arm 78 when the bottom pivot arm is in its most downward position, or at rest. The bottom electric switch 80 is configured to activate a second electric motor 82 that causes the rotation of the second roll 46. A bottom brake 84, may be mounted to the bottom pivot arm to brake the rotation of the second roll. The bottom brake may comprise a strap of material attached at one end to the bottom pivot arm that extends to, and is wrapped around, the circumference of a second roll axle 47. The strap may be of sufficient length so, when in the bottom pivot arm is in its resting position, the bottom pivot arm exerts a tension on the strap and imposes a frictional force upon the second roll axle to stop its rotation.

The first electric motor 66 comprises a shaft 86 which is connected to a first drive wheel 88. The motor may be mounted to one end of a first hinge plate 90. The other end of the hinge plate is hingedly supported above the plane of the first roll 44. During operation of the newspaper wrapping machine, the first hinge plate and the first motor is placed in a lowered position with the first drive wheel 88 in contact with the outside surface of the first roll 44 near the center of the roll. The first electric motor is configured so that it rotates in a counter-clockwise fashion to effect a clockwise rotation of the first roll upon activation by the top electric switch 64. The first drive wheel 88 is loaded by its weight or gravity to frictionally engage the outside surface of the first roll 44. Upon activation, the first electric motor 66 causes the drive wheel 88 to rotate against the outside surface of the first roll 44, effecting the payout of the top sheet 48 from the first roll. It is desirable to mount the first electric motor on the hinge plate in order to facilitate the easy replacement of the protective material from the first roll. Once the protective material is exhausted, the first electric motor can simply be pivoted upward to permit convenient replacement.

Like the first electric motor, the second electric motor 82 also comprises a shaft 92 which may be connected to a second drive wheel 94. The motor may be mounted to one end of a second hinge plate 96. The other end of the second hinge plate is hingedly supported above the plane of the second roll 46. During operation of the newspaper wrapping machine, the hinge plate and second motor is placed in a lowered position so that the second drive wheel 94 contacts the outside surface of the second roll 46. The second electric motor is configured so that it rotates in a counter-clockwise fashion and effects a clockwise rotation of the second roll upon activation by the bottom electric switch 80. The second drive wheel 94 is loaded by its weight or gravity to frictionally engage the outside surface of the second roll 46. When activated, the second electric motor 82 causes the second drive wheel 94 to rotate against the outside surface of the second roll, effecting the payout of the bottom protective sheet. Like the first electric motor, it is also desirable to mount the second electric motor on the hinge plate in order to facilitate the easy replacement of the protective material from the second roll.

The top electric switch 64 activates the first electric motor when the tension imposed upon the top sheet 48 by a newspaper entering the machine is sufficient to cause the top dance bar and top pivot arm to raise a predetermined amount from a resting position. Once the top pivot bar begin to rise, the frictional force imposed upon the first roll axle 45 by the top brake 68 is also released, allowing the first roll to rotate freely. Accordingly, once a newspaper being carried through the wrapping machine imposes a sufficient degree of tension upon the protective sheet to raise the top dance bar and trigger the top electric switch, the first electric motor will cause the rotation of the first roll and effect payout of the top sheet of protective material.

In similar fashion, the bottom electric switch 80 activates the second electric motor when the tension imposed upon the bottom sheet 50 by a newspaper entering the machine is sufficient to cause the bottom dance bar and bottom pivot arm to raise a predetermined amount from a resting position. Once the bottom pivot bar raises, the frictional force imposed upon the second roll axle 47 by the bottom brake 84 is released, allowing the second roll to rotate freely. Accordingly, once a newspaper being carried through the wrapping machine imposes a sufficient degree of tension upon the protective sheet to raise the bottom dance bar and trigger the bottom electric switch, the second electric motor will cause the rotation of the second roll and effect payout of the bottom sheet of protective material.

Alternatively, the first and second electric motors may be operated by an electric circuit activated by the light source 18 and the photocell 19 near the entrance of the machine. As the newspaper passes into the machine and breaks the light beam the electric circuit may be activated after a predetermined time delay. The time delay may be of sufficient duration to commence operation of the first and second motor when the leading edge 24 of the newspaper contacts the sheet of protective material 26.

Using the first and second electric motors to effectuate the payout of the top and bottom sheets, respectively, eliminates problems associated with a passive payout operation. The passive payout operation depends on the rigidity of the particular newspaper, as it is carried through the wrapping machine, to exert and maintain a sufficient amount of continuous tension on the sheet of protective material 26 to cause the first and second rolls to rotate and payout the top and bottom sheets. The passive payout operation has been known to be problematic when used to wrap newspapers having a relatively smaller contents, i.e., weekday newspapers, neighborhood newspapers, or the like. Such newspapers are typically thinner than the weekend newspapers and, thus lack the rigidity to maintain a sufficient tension on the sheet of protective material to effect the rotation of the first and second rolls and the payout of the protective sheets without causing the newspaper to bend or fold. The bending and folding of such newspapers during the wrapping operation produces a product that must be rewrapped before delivery to the customer, defeating the advantages and efficiency of using a machine. Additionally, using a passive payout operation to wrap such newspapers may ultimately cause the machine to jam and shutdown. In either case, the use of a passive operation may adversely affect the ability to wrap and deliver the newspaper in a timely fashion.

Once the newspaper has entered the machine and has activated the top and bottom electric switches, effecting the payout of the top and bottom sheets over the top and bottom surface of the newspaper, it will continue to travel through the machine until the entire length of the newspaper has passed under the light source 18, at which time the beam of light from the light source is reestablished. After a short predetermined time delay sufficient to permit the transport of the rear edge of the newspaper to a point between a cylinder 98 and the conveyor 22, the energizing circuit for the conveyer is broken and the newspaper comes to rest in the wrapping machine 10, substantially between drums 100 and 102.

If the first and second electric motors are operated by an electric circuit activated by the light source 18 and photocell arrangement, the electric circuit may be deactivated in response to the reestablishment of the beam after the same predetermined time delay that deactivates the conveyor 22. Accordingly, both the conveyor and the rotation of the first and second rolls may be deactivated simultaneously.

In response to the reestablishment of the beam of light an electric circuit is completed after the same predetermined time delay that actuates a cutting and sealing mechanism (not shown) for sealing the side edges of the top and bottom sheets together, and simultaneously sealing and cutting the top and bottom sheets at the rear edge of the newspaper. For purposes of clarity and illustration, the cutting and sealing mechanism is not shown in FIG. 1. However, the cutting and sealing mechanism generally may comprise a rectangular shape frame that is hingedly supported at one end above the plane conveyor, and at the other end is connected to a means for lowering the cutting and sealing mechanism down onto the surface of the top protective sheet enveloping the newspaper. For purposes of reference, the cutting and sealing mechanism is shown in U.S. Pat. No. 3,559,367, in FIG. 2.

Figure 3:
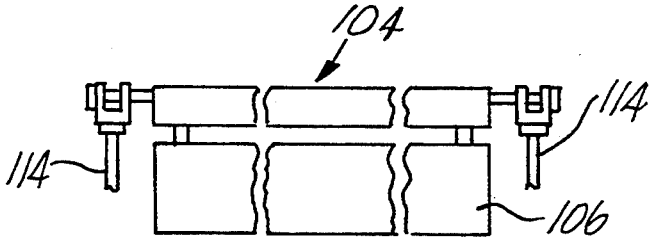
FIG. 3 is a front view of a front sealing bar.
Figure 4:
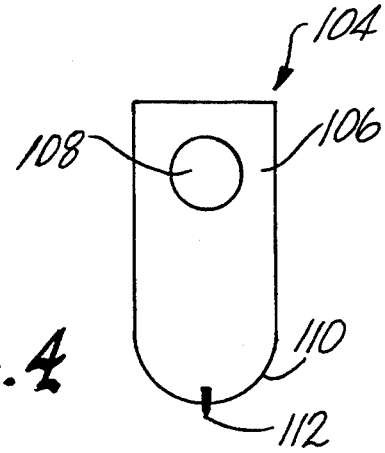
FIG. 4 is a side view of the front sealing bar.

The cutting and sealing mechanism comprises a front sealing bar 104, as shown in FIGS. 1, 3 and 4. The front sealing bar comprises a metal body 106 having a sufficient length to contact the full width of the top and bottom sheets. The metal body may be made from any well known metal material such as carbon steel, aluminum, or the like. A preferred material is aluminum. As shown in FIG. 3, a heating element 108 is disposed within the metal body for transferring heat to the metal body. The heat is transferred from the heating element to the surface of the metal body in order to provide a predetermined temperature needed to melt the top and bottom sheets together upon contact with the sealing bar. The portion of the sealing bar which communicates with the top and bottom sheets is referred to as the sealing edge 110 and may be rounded or contoured in order to minimize undesirable interference with the surface of the protective sheet. Disposed in the center of the sealing edge is a cutting blade 112 which extends across the length of the sealing bar. The cutting blade may protrude from the surface of the sealing edge a predetermined amount in order to effect the cutting of the top and bottom sheets. In a preferred embodiment, the cutting blade may protrude from the surface of the sealing edge in the range of from one-thirty second to one-sixteenth of an inch.

The sealing bar effects the simultaneous sealing and cutting of the width of the top and bottom sheets near the rear edge of the newspaper. As the sealing bar is lowered and placed into contact with the top and bottom sheets, the heat that is transferred from the heating element 108 to the sealing edge causes the top and bottom sheet on each side of the cutting blade 112 to melt together, forming a seal. At the same time that the top and bottom sheets are melted together, the cutting blade, which is also heated by the heating element, cuts through the top and bottom sheets. In order to prevent sticking and unwanted accumulation of melted protective material, i.e., plastic, about the sealing edge during the sealing operation, the metal body may be coated with a non-stick coating such as teflon or the like. In a preferred embodiment the metal body, including the sealing edge is coated with teflon. Alternatively, only the sealing edge of the front sealing bar may be coated with teflon if desired.

The sealing bar is configured having the cutting blade positioned in the center of the sealing edge in order to seal together the top and bottom sheets at both sides of the cut. Accordingly, once the sealing bar has been lowered into contact with the top and bottom sheets, and has sealed together and cut the top and bottom sheets at the rear edge of the newspaper, the top and bottom sheets will be sealed together forming a single continuous sheet of protective material 26 that will contact the leading edge of a subsequent newspaper entering the wrapping machine.

The sealing bar is lowered onto the top and bottom sheets by a pair of arms 114, each arm being connected to an air cylinder supported below the plane of the conveyor 22, as shown in FIG. 3. Upon activation, the air cylinders retract the arms causing the sealing bar to move in a downward direction into contact with the top and bottom sheets and effect the simultaneous sealing and cutting of the top and bottom sheets. Upon its activation, in a preferred embodiment, the front sealing bar may be lowered into contact with the top and bottom sheets for approximately one-quarter to one-half of a second.

Once the sealing and cutting mechanism has been activated and the sealing bar has sealed together and cut the top and bottom sheets, the sealed portion of the top and bottom sheets independent of the newspaper forming the continuous sheet of protective material 26 will retract back towards the entrance of the machine until stopped by the first and second edge guides. The retraction of the sheet of protective material is caused by the constant tension imposed upon both the top sheet by the top dance bar 58, and the bottom sheet by the bottom dance bar 74. After the top and bottom sheets have been cut, the continuous sheet of protective material is retracted, causing both the top and bottom dance bars to pivot downwardly to their respective resting position. As each dance bar reaches its resting position each respective electric switch will be deactivated, causing the first and second electric motors to stop and the top and bottom brakes to terminate the rotation of the first and second rolls.

Although the rotation of the first and second roll may be terminated by the deactivation of the first and second electric motors alone, the top and bottom brakes assist to stop the rotation in a quicker and more controlled manner. This is particularity desirable when the amount of protective material on the first and/or second roll is small and, thus the outside diameter of the sheet of protective material approaches the diameter of the first and/or second roll axle. In such an instance, a single revolution of each electric motor would cause the more than a single revolution of each roll. In this situation, the brakes serve to promptly stop the continued rotation of the rolls and terminate deployment of the sheets.

Figure 5:
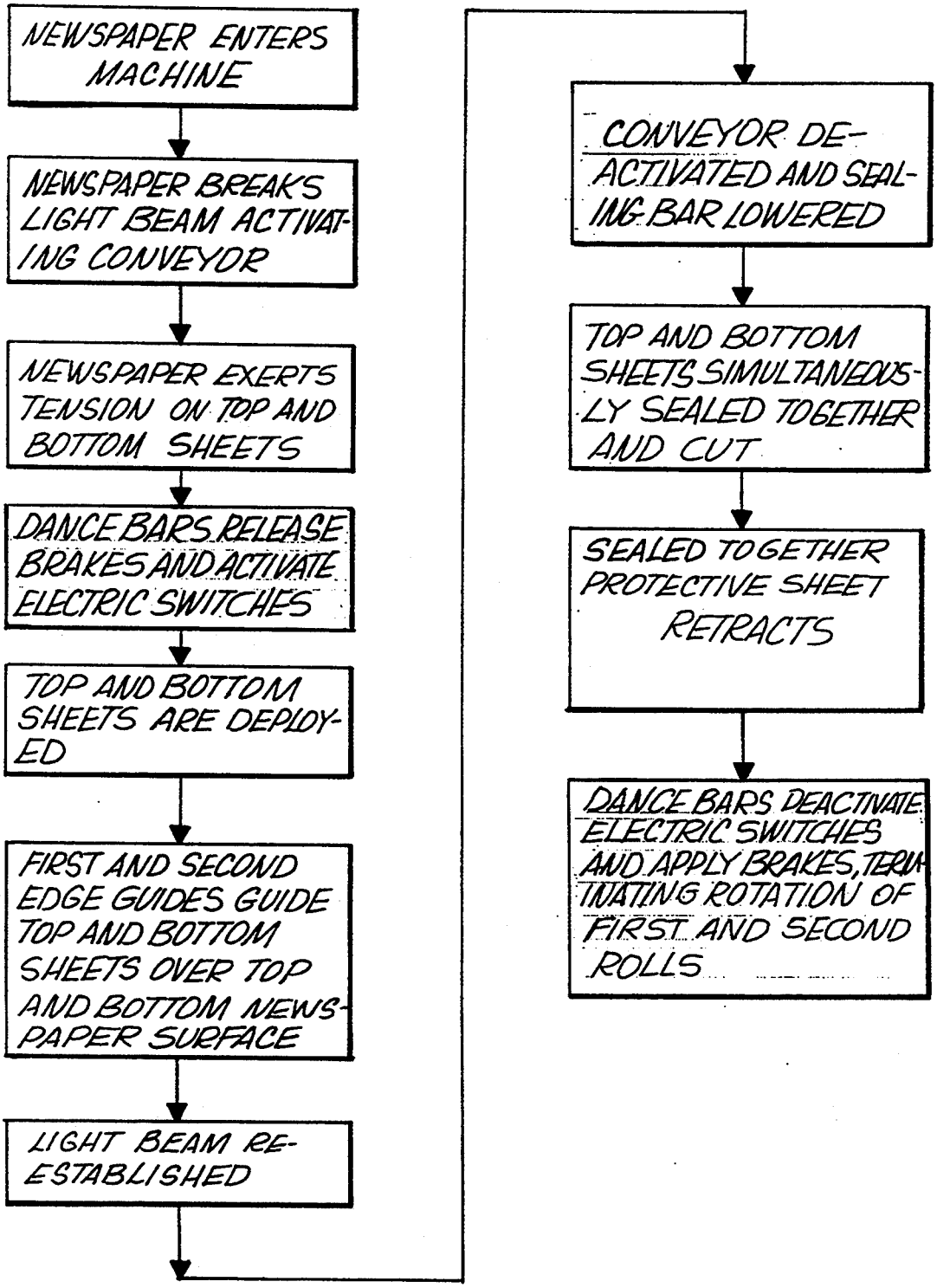
FIG. 5 is a block diagram illustrating the step-wise operation of the machine in wrapping a newspaper.

The enveloping operation for a newspaper according to principles of the present invention is summarized in the block diagram in FIG. 5. In summary, a newspaper is enveloped in a sheet of protective material as it travels via conveyor through the newspaper wrapping machine 10. As the newspaper enters the machine it interrupts a light source 18 which activates the conveyor 22. The newspaper is transported further into the machine until its leading edge comes into contact with the continuous sheet of protective material 26 comprising the top sheet 48 and the bottom sheet 50. As the newspaper travels through the machine a pair of first edge guides 28 guide the placement of the top sheet over the top surface of the paper, and a pair of second edge guides 30 guides the placement of the bottom sheet over the bottom surface of the paper.

The newspaper imposes a tension on the top sheet as it passes through the machine, causing the top dance bar 58 to raise upwardly, simultaneously activating the top electric switch 64 and releasing the top brake 68. In similar fashion, the newspaper also imposes a tension on the bottom sheet, causing the bottom dance bar 74 to raise upwardly, simultaneously activating the bottom electric switch 80 and releasing the bottom brake 84. The activated electric switches operate the first electric motor 66 and the second electric motor 82 causing the first roll 44 and second roll 46 to rotate and deploy the top and bottom sheets onto the respective surfaces of the newspaper.

The light source is reestablished once the entire length of the newspaper has passed by the light source and, after a predetermined time delay, the conveyor 22 is deactivated and the teflon coated front sealing bar 104 is lowered onto the top and bottom sheets near the rear edge of the newspaper. The sealing bar simultaneously seals the top and bottom sheets together, enveloping the newspaper, and cuts the top and bottom sheets, forming a sealed sheet of protective material 26 that retracts back against the first and second edge guides. The top and bottom dance bars are returned to their respective resting position, simultaneously deactivating the electrical switches, applying the brakes and, thus terminating rotation of the first and second rolls. This cycle is repeated when a subsequent newspaper breaks the beam of the light source, causing the wrapped newspaper to exit the machine via the conveyor.

Although specific embodiments of an improved newspaper wrapping machine have been described herein, many modifications and variations will be apparent to those skilled in the art. For example, the enumerated components of newspaper wrapping machine may be located or mounted in the machine at different locations then those specifically described in relation to the plane of the conveyor.

An alternative embodiment of the newspaper wrapping machine according to principles of this invention may comprise a first and second electric motor operated simultaneously by a single electric switch. In such an embodiment, the electric switch may be activated by the movement of a single dance bar in communication with either the top or bottom sheet.

It is, therefore, to be understood that, within the scope of the appended claims, this invention may be practiced otherwise than as specifically described.

What is claimed is:

1. A newspaper packaging machine for enveloping newspapers in sheets of protective film supplied from two rolls comprising: a conveyer within the machine for carrying newspapers individually in a flat, horizontal position through the machine;

a first roll rotatably supported in a horizontal position above the plane of the conveyer;

a first electric motor connected to the first roll for rotating the first roll and feeding a top sheet of protective material;

a second roll rotatably supported in a horizontal position below the plane of the conveyer;

a second electric motor connected to the second roll for rotating the second roll and deploying a bottom sheet of protective material;

means for actuating the motors responsive to a newspaper entering the machine; and a pair of first edge guides positioned in an opposed relation near an entrance of the conveyer, wherein each first edge guide comprises a pair of wheels that communicate with each other at their circumference, and wherein side edge portions of the top sheet are placed between the wheels for guiding the top sheet onto a top surface portion of the newspaper.

2. The newspaper packaging machine as claimed in claim 1 comprising a cylindrical bar in communication with top sheet of protective material and a cylindrical bar in communication with bottom sheet of protective material, each cylindrical bar being mounted to a pivot arm hingedly mounted to the machine.

3. The newspaper packaging machine as recited in claim 2 comprising an electric switch connected to the cylindrical bar in communication with the top sheet for activating the first electric motor, and an electric switch connected to the cylindrical bar in communication with the bottom sheet for activating the second electric motor, each electric switch being activated upon movement by a respective cylindrical bar.

4. The newspaper packaging machine as recited in claim 3 comprising a brake activated by the movement of the cylindrical bar in communication with the top sheet for stopping the rotation of the first roll, and a brake activated by the movement of the cylindrical bar in communication with the bottom sheet for stopping the rotation of the second roll.

5. The newspaper packaging machine as recited in claim 1 comprising a front sealing bar hingedly supported above the plane of the conveyer, the sealing bar serving to seal the sheets of film together and simultaneously cut the sheets of film after a newspaper has been completely enveloped, the sealing bar comprising:

a heating element disposed within a metal body of sufficient length to contact the width of the sheets of film from the first and second rolls;

a seal edge extending the length of the metal body, the sealing edge having a rounded configuration; and a cutting blade protruding from the sealing edge.

6. The newspaper packaging machine as recited in claim 1 comprising a pair of second edge guides, each second edge guide being positioned coplaner with the plane of the conveyer in an opposed relation near the entrance of the conveyer, each second edge guide comprising a pair of wheels that communicate with each other at their circumference, each side edge of the bottom sheet being placed between the wheels for guiding the bottom sheet onto the bottom surface of a newspaper and preventing lateral movement of the top sheet as the newspaper is carried by the conveyer through the machine.

7. A newspaper packaging machine for enveloping newspapers in sheets of film supplied from two rolls comprising;

a conveyor for carrying newspapers individually in a flat, horizontal position through the machine;

a first roll rotatably supported in a horizontal position above the conveyer, the first roll being rotated by a first electric motor for deploying a top sheet of protective material, the first electric motor being activated by an electric switch that registers movement of a top dance bar hingedly supported above the plane of the conveyer, the top dance bar being in communication with the top sheet;

a second roll rotatably supported in a horizontal position below the conveyer, the second roll being rotated by a second electric motor for deploying a bottom sheet of protective material, the second electric motor being activated by an electric switch that registers movement of a bottom dance bar hingedly supported above the plane of the conveyer, the bottom dance bar being in communication with the bottom sheet;

a pair of first edge guides mounted above the plane of the conveyer, each edge guide being positioned at opposing ends of the entrance to the machine for guiding and preventing lateral movement of the top sheet as it is placed over a top surface of a newspaper;

a pair of second edge guides mounted coplaner with the plane of the conveyer, each edge guide being positioned at opposing ends of the entrance to the machine for guiding and preventing lateral movement of the bottom sheet as it is placed over a bottom surface of the newspaper; and a sealing bar hingedly supported above the plane of the conveyor to seal together the top and bottom sheets of protective film and simultaneously cut the sheets after the newspaper is enveloped.

8. The newspaper packaging machine as recited in claim 7 wherein the sealing bar comprises a heating element disposed within a metal body, the metal body comprising a rounded sealing edge for contacting and sealing the sheets of film, the sealing edge having a cutting blade disposed within the sealing edge that extends across the length of the sealing bar, the blade protruding a predetermined length from the surface of the sealing edge, the sealing bar being coated with a nonstick material.

9. A newspaper packaging machine for enveloping newspapers in sheets of protective film supplied from two rolls comprising:

a conveyer for carrying newspapers individually in a flat, horizontal position;

a first roll rotatably supported in a horizontal position above the plane of the conveyer;

a second roll rotatably supported in a horizontal position below the plane of the conveyer;

a pair of first edge guides for guiding the sheet of film from the first roll over the top surface of the newspaper as it is carried through the machine by the conveyer, each first edge guide being positioned above the plane of the conveyer in an opposed relation near the entrance of the machine; and a pair of second edge guides for guiding the sheet of film from the second roll over the bottom surface of the newspaper as it is carried through the machine by the conveyer, each second edge guide being positioned coplaner with the conveyer in an opposed relation near the entrance of the machine.

10. The newspaper packaging machine as recited in claim 9 comprising a front sealing bar hingedly supported above the plane of the conveyer of sufficient length to contact the width of the sheets of film from the first and second rolls, the sealing bar serving to seal the sheets of film together and simultaneously cut the sheets of film after a newspaper has been completely enveloped.

11. The newspaper packaging machine as recited in claim 9 comprising a first electric motor connected to the first roll for rotating the first roll and deploying a top sheet of protective material, and a second electric motor connected to the second roll for rotating the second roll and deploying a bottom sheet of protective material.

12. The newspaper packaging machine as recited in claim 11 further comprising a cylindrical bar in communication with the top sheet and hingedly supported above the plane of the conveyor, an electric switch is mounted above the plane of the conveyor for operating the first electric motor, the electric switch being activated by movement of the cylindrical bar in response to a newspaper entering the machine.

13. The newspaper packaging machine as recited in claim 12 further comprising a cylindrical bar in communication with the bottom sheet and hingedly supported below the place of the conveyor, an electric switch is mounted below the plane of the conveyor for operating the second electric motor, the electric switch being activated by movement of the cylindrical bar in response to a newspaper entering the machine.

14. The newspaper packaging machine as recited in claim 13 comprising a top brake connected to an axle of the first roll for stopping the rotation of the first roll, the brake being activated by movement of the cylindrical bar in communication with the top sheet, and a bottom brake connected to an axle of the second roll for stopping the rotation of the second roll, the bottom brake being activated by movement of the cylindrical bar in communication with the bottom sheet.

15. The newspaper packaging machine as recited in claim 10 wherein the sealing bar comprises a heating element disposed within a metal body, the metal body comprising a rounded sealing edge for contacting and sealing the sheets of film, the sealing edge having a cutting blade disposed within the sealing edge that extends across the length of the sealing bar, the blade protruding a predetermined length from the surface of the sealing edge, the sealing bar being coated with a nonstick material.

16. A newspaper packaging machine for enveloping newspapers in sheets of film supplied from two rolls comprising;

a conveyor for carrying newspapers individually in a flat, horizontal position through the machine;

a first roll rotatably supported in a horizontal position above the conveyer for deploying a top sheet of protective material;

a second roll rotatably supported in a horizontal position below the conveyer for deploying a bottom sheet of protective material; and a sealing bar hingedly supported above the plane of the conveyor to seal together the top and bottom sheets of protective film and simultaneously cut the sheets after the newspaper has been enveloped, the sealing bar comprising:

a rounded sealing edge extending lengthwise across the sealing bar, wherein the sealing edge comprises a metal body having a heating element disposed therein; and a cutting blade disposed within the sealing edge and extending lengthwise across the sealing bar, wherein the cutting blade projects a predetermined distance from a central position of a surface portion of the sealing edge.

17. The newspaper packaging machine as recited in claim 15 comprising a pair of first edge guides, each first edge guide being positioned above the plane of the conveyer in an opposed relation near the entrance of the conveyer, each first edge guide comprising a pair of wheels that communicate with each other at their circumference, each side edge of the top sheet being placed between the wheels for guiding the top sheet onto the top surface of a newspaper and preventing lateral movement of the top sheet as the newspaper is carried by the conveyer through the machine.

18. The newspaper packaging machine as recited in claim 17 comprising a pair of second edge guides, each second edge guide being positioned coplaner with the plane of the conveyer in an opposed relation near the entrance of the conveyer, each second edge guide comprising a pair of wheels that communicate with each other at their circumference, each side edge of the bottom sheet being placed between the wheels for guiding the bottom sheet onto the bottom surface of a newspaper and preventing lateral movement of the top sheet as the newspaper is carried by the conveyer through the machine.

19. The newspaper packaging machine as recited in claim 15 comprising a first electric motor for rotating the first roll and a second electric motor for rotating the second roll.

20. The newspaper packaging machine as recited in claim 19 further comprising:

a top dance bar comprising a cylindrical bar rotatably connected to a top pivot arm hingedly supported above the plane of the conveyor, the top dance bar communicating with the top sheet;

a top brake for stopping the rotation of the first roll, the top brake comprising a strap of material in communication with an axle of the first roll and extending to the top pivot arm, the top brake being activated by the movement of the top dance bar;

a top electric switch for operating the first electric motor, the top electric switch being connected to the top pivot arm and being activated by the movement of the top dance bar;

a bottom dance bar comprising a cylindrical bar rotatably connected to a bottom pivot arm hingedly supported below the plane of the conveyor, the bottom dance bar communicating with the bottom sheet;

a bottom brake for stopping the rotation of the second roll, the bottom brake comprising a strap of material in communication with an axle of the second roll and extending to the bottom pivot arm, the bottom brake being activated by the movement of the bottom dance bar; and a bottom electric switch for operating the second electric motor, the bottom electric switch being connected to the bottom pivot arm and being activated by the movement of the bottom dance bar.

21. The newspaper packaging machine as recited in claim 16 wherein the sealing bar is coated with a nonstick material.

* * * * *

UNITED STATES PATENT AND TRADEMARK OFFICE

CERTIFICATE OF CORRECTION

PATENT NO. : 5,428,937

DATED : July 4, 1995

INVENTOR(S) : Albert V. Misik

It is certified that error appears in the above-indentified patent and that said Letters Patent is hereby corrected as shown below:

Column 17, line 8, change "claim 15" to -- claim 16 --.

Column 17, line 32, change "claim 15" to -- claim 16 --.

Signed and Sealed this

Seventeenth Day of October, 1995

*Attest:*

*Attesting Officer*

BRUCE LEHMAN

*Commissioner of Patents and Trademarks*